US005384020A

United States Patent [19]

Oppermann et al.

[11] Patent Number: 5,384,020

[45] Date of Patent: Jan. 24, 1995

[54] ANODE STRUCTURE FOR CATHODIC PROTECTION AGAINST CORROSION, AND METHOD FOR MAKING THE ANODE STRUCTURE

[75] Inventors: Günter Oppermann, Erlensee; Rüdiger Weinhardt, Rodenbach; Stefan Kotowski, Seligenstadt, all of Germany

[73] Assignee: Heraeus Elektrochemie GmbH, Hanua, Germany

[21] Appl. No.: 71,300

[22] Filed: Jun. 2, 1993

[30] Foreign Application Priority Data

Jul. 27, 1992 [DE] Germany ..... 4224539

[51] Int. Cl.[6] ..... C23F 13/10

[52] U.S. Cl. ..... 204/280; 204/196

[58] Field of Search ..... 204/196, 197, 280

[56] References Cited

U.S. PATENT DOCUMENTS

| | | | |
|---|---|---|---|
| 2,863,819 | 12/1958 | Preiser | 204/196 |
| 2,949,417 | 8/1960 | Preiser et al. | 204/196 |
| 3,239,443 | 3/1966 | Bryan et al. | 204/196 |
| 3,326,791 | 6/1967 | Heuze | 204/196 |
| 3,471,395 | 10/1969 | Sumner | 204/196 |
| 4,194,960 | 3/1980 | Bleikamp, Jr. | 204/280 |
| 4,265,725 | 5/1981 | Tatum | 204/196 |

FOREIGN PATENT DOCUMENTS

| | | |
|---|---|---|
| 84875 | 8/1983 | European Pat. Off. . |
| 0102380 | 3/1984 | European Pat. Off. . |

*Primary Examiner*—John Niebling
*Assistant Examiner*—Kishor Mayekar
*Attorney, Agent, or Firm*—Felfe & Lynch

[57] ABSTRACT

Apparatus and method for sealing an electrical connection between an anode structure for cathodic protection against corrosion and a connecting cable with an electrically insulating jacket, an annular body of elastic material, such as rubber for example, which surrounds in a sleeve-like manner the junction between an insulation-stripped end of the connecting cable and a socket on a current feed pin of titanium for the anode structure. By radial compression of a terminal body of plastically deformable material thrust onto the annular body the annular body is pressed at its one end onto the insulating jacket in the end area of the connecting cable and at its other end onto the outer surface of the current connecting pin of the anode structure, in a liquid-tight manner.

6 Claims, 2 Drawing Sheets

ANODE STRUCTURE FOR CATHODIC PROTECTION AGAINST CORROSION, AND METHOD FOR MAKING THE ANODE STRUCTURE

BACKGROUND OF THE INVENTION

The invention relates to an anode structure for cathodic protection against corrosion, having a connecting cable with an electrically insulating covering, the corresponding anode element in the form of an anode or an anode connection having a socket into which the insulation-stripped end of the connecting cable is fitted to form an electrical contact, and the connecting area between connecting cable and anode element being sealed by an electrically insulating seal, the seal being in contact with the covering of the connecting cable, and this seal being surrounded at least partially by a terminal body, and a method for making the anode structure.

European Patent 01 02 380 discloses a metal oxide anode for cathodic protection against corrosion, wherein the anode is configured as a metal oxide anode member in the form of a hollow and substantially cylindrical tube which is open at one end and closed at the opposite end; in the interior this anode has a current receiving interior surface which is plated or coated with an electrically conductive metal or metal alloy, the coating or plating being joined to an electrically conductive cable end member which is fastened at a point that is central relative to the coating or plating; the coating or plating protects the inner surface of the tube with the exception of a relatively narrow area in the upper part of this surface at the open end of the tube, and with the exception of a relatively narrow area at the opposite end of the tube. The centrally fixed cable end member is formed from a bronze spiral. The one open end is sealed by a plastic composition covering the end of the connecting cable.

The seal, especially in the case of a thermosetting casting resin seal, where mechanical tension occurs on account of the absence of a lock between the connecting cable and the anode element, is problematical; moreover, the construction of the spiral structure adjoining the end of the cable covering for contacting purposes is comparatively difficult.

European Patent 84,875 discloses a linear anode structure for cathodic protection against corrosion of elongated metal structures, wherein a power cable provided with electrically insulating covering is connected to the positive pole of a current source and anode segments of valve metal are threaded onto the cable and distributed over its length, which are pinched in sections sealed sleeve-like onto the core of the cable stripped of the covering. This sleeve-like or socket-like portion of the anode segments provided for sealing against the coverings in the transition area is provided with anode surfaces extending star-wise or radially. The application of the anode segments is performed by stripping the electrical cable core in the transitional areas and then applying and crimping a valve-metal sleeve, both the electrically conducting connection to the core and the sealing of the ends of the covering bordering on the transition areas being assured, so that the current transfer area is sealed water-tight from the environment.

Such a system is best used only for elongated objects that are to be protected, such as pipelines, for example, while the cathodic protection from corrosion of other equipment which is exposed to sea water or sunk in the ground, such as small tanks, can be protected only with considerable technical difficulty on account of the great number of anode segments used; also, only those tubes can be used which, if measured in sheet metal or drawn metal or rods are very expensive and have a hard surface that can be coated only poorly.

The invention is addressed to the problem of bringing about a simple, rugged connection between a current-connecting cable and a valve-metal anode which will be suitable for cathodic protection against corrosion not only of compact metal devices but also of a group of metal devices that are exposed to sea water or set in the ground, or can also be used for interior protection. In addition to ease of manufacture, a high reliability and ability to withstand pressure are also to be achieved as regards the transfer of current and moisture-proofing. At the same time, not only tubular anodes, but also anodes of any desired shape are to be able to be connected.

The problem is solved with regard to the apparatus by the fact that the socket is formed in the end of a current feeding pin of the anode element made of valve metal, into which the insulated end of the connecting cable extends, that not only the end of the covering of the connecting cable but also the end of the current feed pin is encompassed by an annular body as seal, consisting of an elastic, electrically insulating material, the pressure in the radial direction required for the sealing being formed by at least one plastically deformable compression collar acting on the seal of the terminal body.

The stability of the seal based on maintaining the flexibility of the seal area proves to be advantageous, so that, in contrast to thermosetting cast resin seals, the seal always holds even when the operating pressure or the working temperature changes, and the formation of gaps between the cast resin and the workpiece can be reliably prevented. The electrical connection can be exposed to a working pressure of up to 25 bar.

It has proven to be especially advantageous to provide an annular body of rubber, especially of neoprene, since then working temperatures up to 90° C. can be employed without losing the seal.

An additional advantage is to be seen in the fact that not only compact single objects can be protected against cathodic corrosion, but also branched systems, such as tanks in refineries can be protected, due to the possibility of branching the current connecting cables. The working pressure acting on the seal can amount to as much as 20 bar.

At the same time the possibility of making the connection in conventional manufacturing apparatus by means of arbor presses and drawing methods proves to be advantageous.

Another advantage is to be seen in the fact that the current connecting pin can be made on the one hand as a component of the anode, but on the other hand it serves only the current-carrying function, while the actual anode is remote from the junction and thus can be made as an anode in any desired form.

SUMMARY OF THE INVENTION

In accordance with the invention, an anode structure for cathodic protection against corrosion, comprises an anode, a connecting cable attached thereto and having an insulation-stripped end, an electrically insulating jacket for the cable, the cable including an anode element in the form of an anode connection having a socket into which the insulation-stripped end of the connecting cable fits forming an electrical contact, an electrically insulating seal for sealing an area of connection between the connecting cable and the anode element, the seal being in contact with the jacket of the connecting cable, this seal being surrounded at least partially by a terminal body comprising at least one plastically deformable compression collar, the anode including a valve-metal current feed pin having a socket formed therein, and the insulation-stripped end of the connecting cable reaching into the socket, the jacket for the connecting cable having an end, an annular body comprising elastic, electrically insulating material as a seal for jacketing sleeve-like the end of the jacket and the end of the current feed pin, the at least one plastically deformable compression collar forming the pressure in a radial direction needed for sealing.

Also in accordance with the invention, a method for making an anode structure for cathodic protection against corrosion, comprises making an anode connection which has a socket, and sealing a connection area between a connecting cable and an anode element by an electrically insulating seal such that the seal is in contact with a jacket of a connecting cable and this seal is surrounded at least partially by a terminal body, the socket being formed in the end of a valve-metal current feed pin of the anode element, and placing an insulation-stripped end of the connecting cable into the socket and joining together the insulation-stripped end and the socket in an electrically insulating and mechanically tight manner, thrusting an annular body including an elastic, electrically insulating material as a seal both over the end of the jacket and over the end of the current feed pin, thrusting a terminal body over the annular body, drawing the terminal body through a drawing die with a hole diminishing conically in a direction of thrust and reducing the cross section of the terminal body by plastic deformation.

For a better understanding of the invention, together with other and further objects thereof, reference is made to the following description, taken in connection with the accompanying drawings, and its scope will be pointed out in the appended claims.

BRIEF DESCRIPTION OF THE DRAWINGS

Referring now to the drawings.

DESCRIPTION OF PREFERRED EMBODIMENTS

Figure 1:
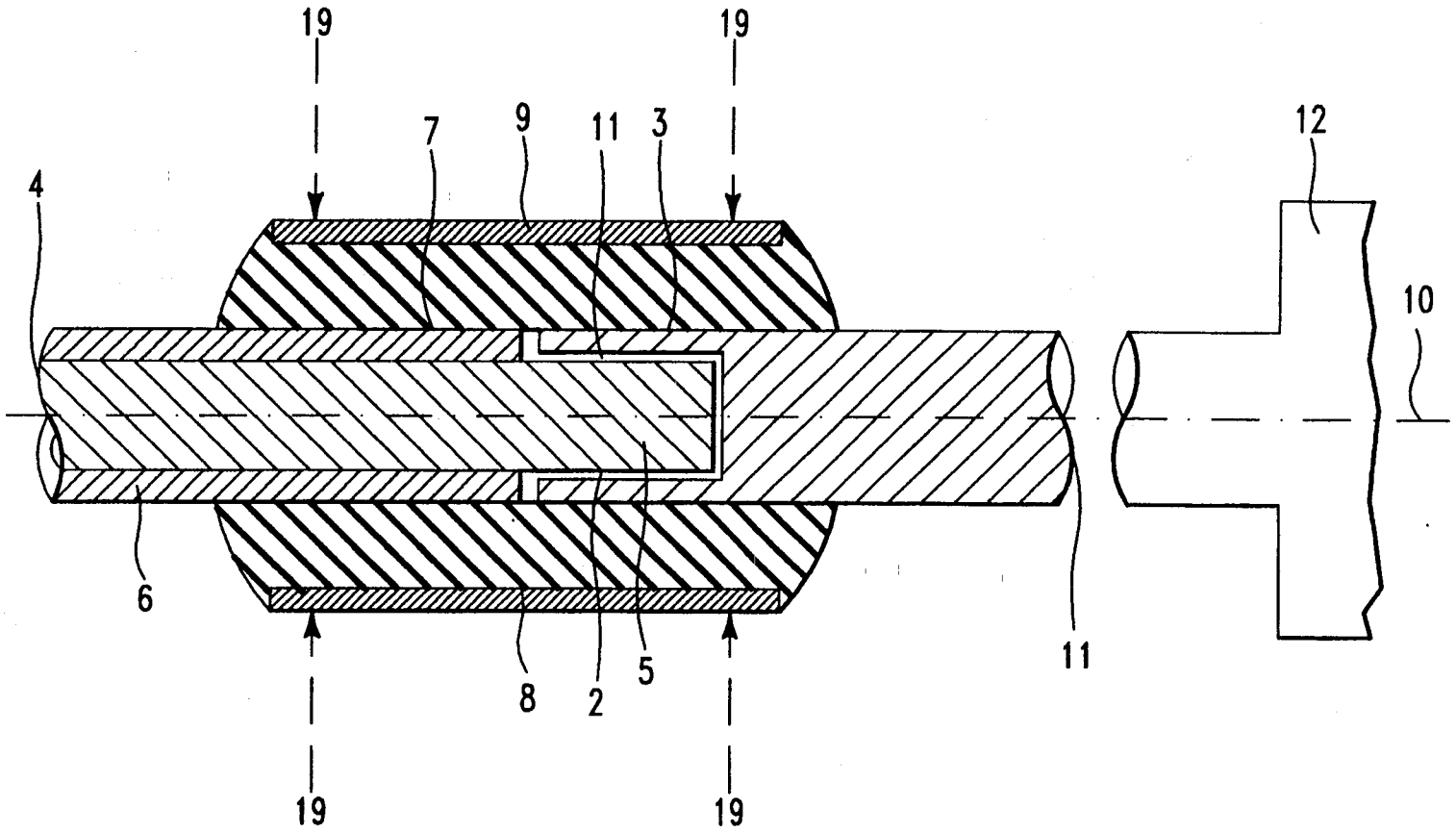
FIG. 1 shows the connection between the connecting cable and the power feed pin in longitudinal section before their final assembly.

In FIG. 1, the current feed pin 1 has at its extremity 3 a socket 2 into which the stripped end 5 of a copper or copper alloy cable 4 reaches and is anchored in the socket in an electrically conductive and mechanically tight manner by compression. The power feeding pin 1 and the connecting cable 4 are at least approximately axially symmetrical and disposed on an axis 10. Outside of the socket 2 the connecting cable 4 is provided with an electrically insulating covering 6. The end 3 of the power feed pin 1 and the end 7 of the covering 6 of the connecting cable are, together with the junction, encompassed by an annular body 8 of elastic material which in turn is encompassed by a plastically deformable terminal body 9. The electrically conducting and mechanical junction between the core 5 and the contact area on the inside surface of the socket 2 is achieved by compression between the end 3 of the power feed pin 1 and the material of the core 5. The end 3 of the current feed pin 1 and the end 7 of the jacket 6 of the current connecting cable 4 are surrounded by the annular body 8 of elastic material which has along the axis 10 a bore which surrounds the two ends together with the junction 11 between core 5 and current feed pin 1. The annular body 8 preferably made of rubber or silicone is in turn surrounded by a terminal body 9 which consists of a plastically deformable material, which is titanium in the present case. By compression in the radial direction symbolized by the arrows 19, the annular body 8 is pressed onto the ends 3 and 7 of the power feed pin 1 and connecting cable 4 so that the junction is sealed off liquid-tight against the external environment. Reference number 12 indicates the valve-metal anode, preferably the titanium anode in the present case. The anode can be tubular, but it is also possible to provide an anode of any shape in connection with the power connecting pin.

Figure 2:
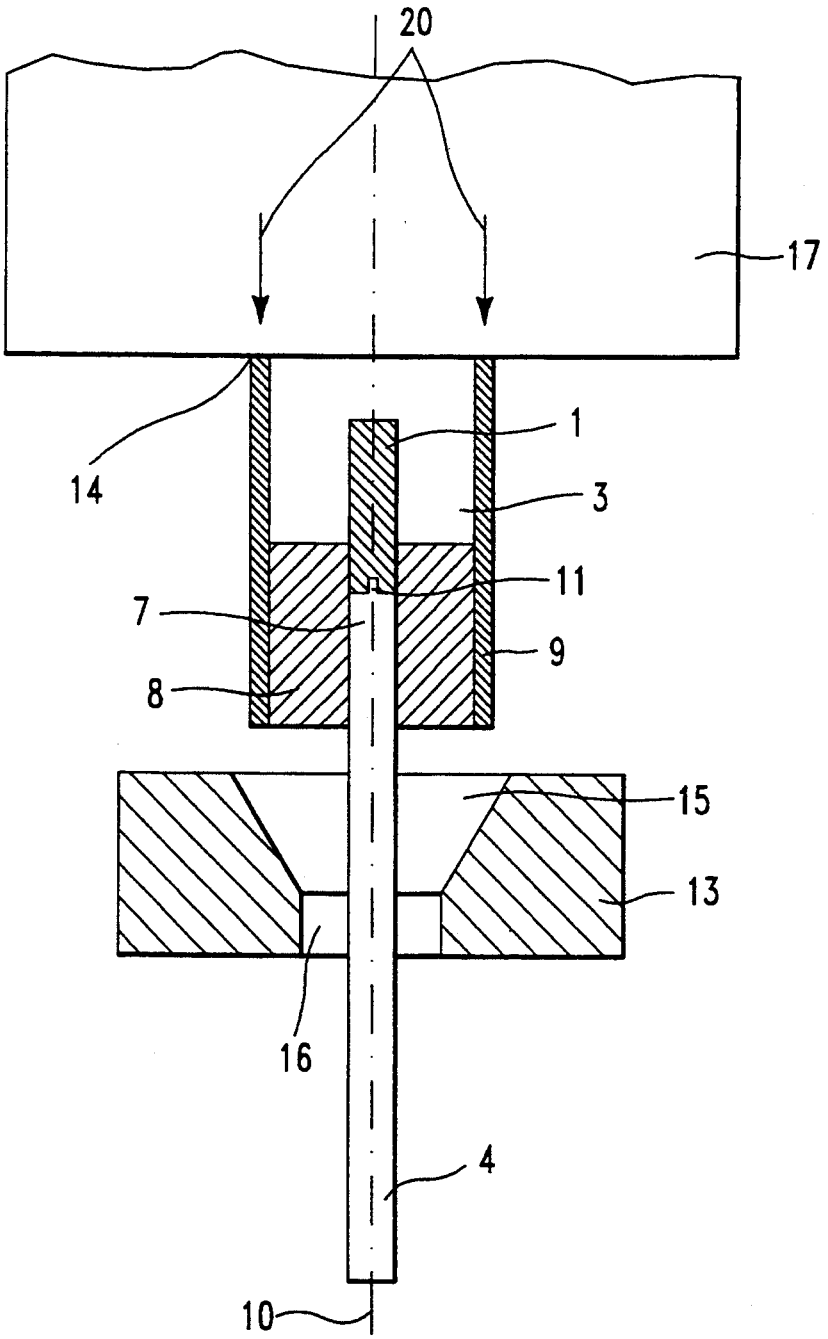
FIG. 2 shows a step in the process of manufacture.

In FIG. 2, the connecting cable 4 is passed through a conically tapering hole in a steel drawing die 13, the end 7 of the current connecting cable 4 being already joined to the power feed pin 1 in an electrically conducting and mechanically tight manner by squeezing its stripped end in the socket of the power feed pin 1. The junction 11 is surrounded coaxially with the axis 10 by the elastic annular body 8 and the terminal body 9, the terminal body 9 reaching past the end of the power feed pin 1. At the projecting, collar-like end 14 of the terminal body 9, the ram 17 of an arbor press only partially indicated is engaged, which introduces and forces the entire arrangement consisting of the connecting cable 4, the power feed pin 1, the annular body and the annular jacket into the conically tapering hole 15 and the adjoining cylindrical bore 16 of the drawing die 13. On account of the pressure exerted by the ram 17 of the arbor press along the axis 10 onto the end 14 of the plastically deformable terminal body the diameter of the terminal body 9 is reduced by passing through the steel drawing die 13, so that an elevated pressure builds up radially on the annular body 8 and provides for the desired liquid-tight terminal at both ends 3 and 7 of the power feed pin 1 and connecting cable 4. The action of the pressure exerted by the ram 17 is symbolized by the arrows 20.

In a practical embodiment, the power feed pin preferably is made of titanium with a diameter of 10 mm, while the annular jacket 9 preferably consists of a titanium tube with a diameter of 32 mm. After passing through the steel drawing die 13, the terminal body 9 has a diameter of, for example, only 26 mm, so that the result is a reduction of the diameter by, for example, approximately 0.8. In addition to titanium, VA steel and heat-deformable plastic have proven to be good materials for the terminal body in good conducting media. The dimensions of the ends of the Dower feed pin 1 and connecting cable 4 remain virtually unaltered.

While there have been described what are considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Anode structure for cathodic protection against corrosion, comprising: an anode, a connecting cable attached thereto having an insulation-stripped end and electrically insulating jacket, a terminal body means comprising at least one plastically deformable compression collar for causing a pressure in a radial direction needed for sealing, and a single electrically insulating seal the anode including an anode element in the form of an anode connection having a socket into which the insulation-stripped end of the connecting cable fits forming an electrical contact, said seal sealing an area of connection between the connecting cable and the anode element, said seal being in contact with the jacket of the connecting cable, said seal being surrounded at least partially by the terminal body, the anode including said anode element comprising a valve-metal current feed pin having an end with said socket formed therein, and the insulation-stripped end of the connecting cable reaching into said socket, said seal comprising an annular body of an elastic, electrically insulating material for jacketing sleeve-like an end of said jacket and said end of the current feed pin.

2. Anode structure according to claim 1, in which said socket has a contact surface having at least in part a metal or a metal alloy whose electrical conductivity is greater than that of the valve metal of the valve-metal pin.

3. Anode structure according to claim 1, in which the socket of the current feed pin pinches the insulation-stripped end of the connecting cable.

4. Anode structure according to claim 1, in which the annular body comprises rubber.

5. Anode structure according to claim 1, in which the terminal body comprises valve metal.

6. Anode structure according to claim 5, in which the valve metal is titanium.

* * * * *